US007300386B2

(12) United States Patent
Sjöstam

(10) Patent No.: US 7,300,386 B2
(45) Date of Patent: Nov. 27, 2007

(54) PLAY AND TRAINING EQUIPMENT

(75) Inventor: Sven Åke Sjöstam, Aneby (SE)

(73) Assignee: AB Hags Mekaniska, Aneby (SE)

( * ) Notice: Subject to any disclaimer, the term of this patent is extended or adjusted under 35 U.S.C. 154(b) by 0 days.

(21) Appl. No.: 09/992,454

(22) Filed: Nov. 6, 2001

(65) Prior Publication Data

US 2003/0013578 A1 Jan. 16, 2003

(30) Foreign Application Priority Data

Jul. 12, 2001 (DE) ..... 401 06 489
Jul. 12, 2001 (SE) ..... 0102538

(51) Int. Cl.
*A63B 17/00* (2006.01)
*A63B 26/00* (2006.01)

(52) U.S. Cl. ..... 482/36; 482/23

(58) Field of Classification Search ..... 482/35, 482/36, 37, 121, 123, 129, 140, 87, 90, 23; 248/599–601

See application file for complete search history.

(56) References Cited

U.S. PATENT DOCUMENTS 1,731,412 A * 10/1929 Froesch ..... 248/601
2,222,119 A * 11/1940 Overholt ..... 482/35
3,656,805 A * 4/1972 Engstrom ..... 297/303.5
3,850,428 A * 11/1974 Zuber ..... 482/36
4,278,250 A * 7/1981 Baynes et al. ..... 482/36
4,363,499 A * 12/1982 Watanabe et al. ..... 280/775
4,627,612 A * 12/1986 Gehlbach ..... 482/36
4,720,068 A * 1/1988 Tornero ..... 248/161
4,815,331 A * 3/1989 Land ..... 74/494
5,118,099 A * 6/1992 Vatterot ..... 482/35
5,167,595 A * 12/1992 Gleeson et al. ..... 482/35
5,330,400 A * 7/1994 Huberman ..... 482/35
5,470,038 A * 11/1995 Clark ..... 248/156
5,967,901 A * 10/1999 Briggs ..... 472/128
6,010,429 A * 1/2000 Prueitt ..... 482/4
6,053,845 A * 4/2000 Publicover et al. ..... 482/35
6,090,018 A * 7/2000 Laudenslager et al. ..... 482/87
6,095,950 A * 8/2000 Katz ..... 482/35
6,174,266 B1 * 1/2001 Merrill ..... 482/35
6,302,824 B1 * 10/2001 MacAdam et al. ..... 482/37
6,475,117 B1 * 11/2002 Berglund et al. ..... 482/35
6,503,174 B2 * 1/2003 Mantooth ..... 482/37
2002/0091041 A1 7/2002 Mantooth

FOREIGN PATENT DOCUMENTS

EP 0206105 12/1986
EP 0743082 9/2000
GB 1405885 9/1975

OTHER PUBLICATIONS

Search report for EP 02077616.

* cited by examiner

*Primary Examiner*—Fenn C. Mathew
(74) *Attorney, Agent, or Firm*—Polster, Lieder, Woodruff & Lucchesi, L.C.

(57) ABSTRACT

The present invention refers to play and training equipment. The equipment is mainly intended to be used at playgrounds and the like places but may also find use at many other locations. An equipment according to the invention comprises at least one post or preferably two or more posts which are erected in vertical direction. Between the posts or a post and the ground or other support there are one or more movable elements or units, the movements of which are dampened or suppressed and of limited extension by connectors having internal bushings and which mount the units to the posts.

15 Claims, 3 Drawing Sheets

PLAY AND TRAINING EQUIPMENT

CROSS-REFERENCE TO RELATED APPLICATIONS

This application claims priority to Swedish application Ser. No. 0102538-6 filed Jul. 12, 2001 and German application Ser. No. 40106489.1, filed Jul. 12, 2001, both of which are incorporated herein by reference.

STATEMENT REGARDING FEDERALLY SPONSORED RESEARCH OR DEVELOPMENT

Not Applicable.

BACKGROUND OF THE INVENTION

The present invention refers to play and training equipment. The equipment is mainly intended to be used at playgrounds and the like places but may also find use at many other locations.

BRIEF SUMMARY OF THE INVENTION

Equipment according to the invention comprises at least one post or preferably two or more posts which are erected in vertical direction. Between the posts or a post and the ground or other support there are one or more movable elements or units, the movements of which are dampened or suppressed and of limited extension. The moving elements have various functions giving a maximum of stimulation to find new ways of climbing, balancing and coordinating in a rhythmic way in three dimensional directions. The inertia of the movements give a special feeling of speed and rapid movements. The movements are affected by the lever arm function that the user may achieve by coordinated movements of the body.

The play and training equipment according to the invention and embodiments thereof includes one or more units such as bridge, ladder or the like mounted in such a way that they can move with a limited and dampened swinging movement around an imaginary axis between the mounting shaft ends at each end of the unit.

The units each comprise a frame forming a closed loop and a number of members inside the frame. The frame preferably has an elliptic shape and the members are parallel to the short axis of the ellipse. The outer frame, in one embodiment, forms a bow. In one embodiment, the members inside the frame are bowed or curved towards either side of the frame.

The connector which mounts the play units to the posts include an outer shell and a bushing within the shell. The connector enables the play unit to move with a limited and dampened swinging movement around an imaginary axis between the mounting shaft ends at each end of the unit. The bushing surrounds a mounting shaft of the play unit. Preferably, the bushing comprises discrete bushing elements spaced about said shell. The connector can include an inner tube which is received within the bushing. The inner tube, in turn, receives the mounting shaft of the play unit.

The invention will below be described more in detail with reference to the accompanying drawings.

BRIEF DESCRIPTION OF THE SEVERAL VIEWS OF THE DRAWINGS

Corresponding reference numerals will be used throughout the several figures of the drawings.

DETAILED DESCRIPTION OF THE INVENTION

Figure 1:
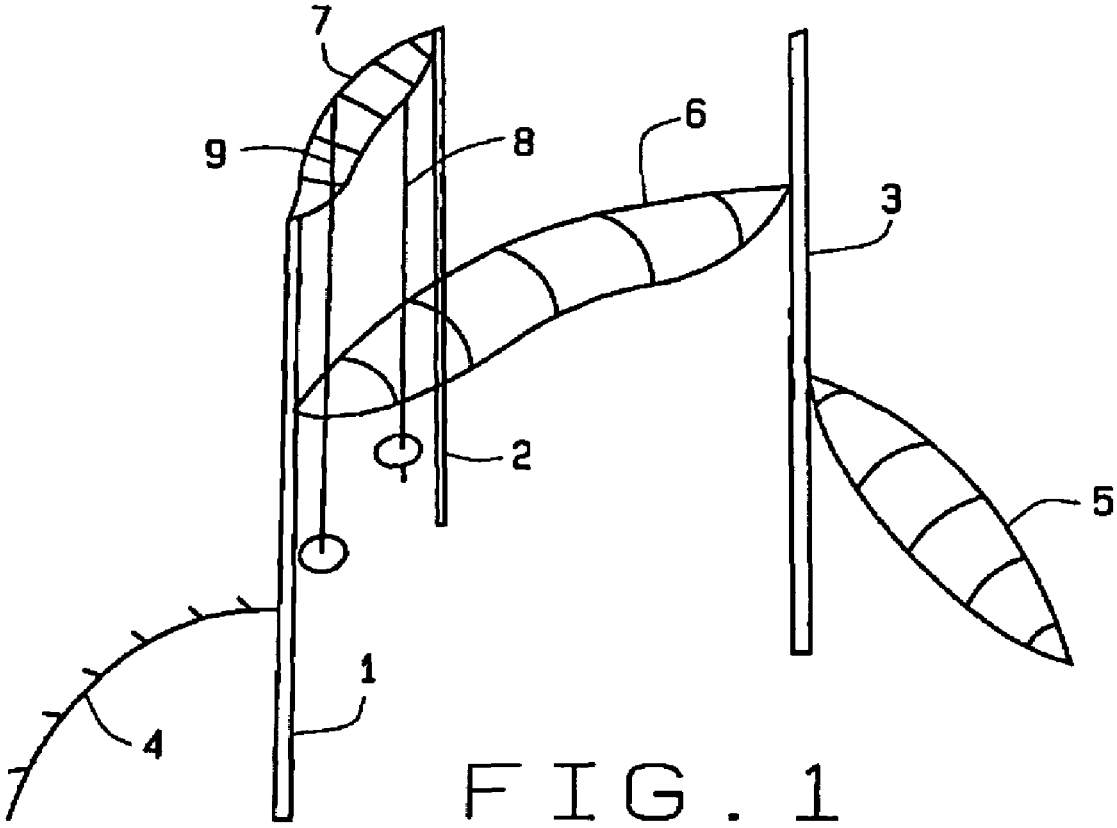
FIG. 1 is a perspective view of play and training equipment according to the invention.

The play and training equipment of FIG. 1 includes three posts 1-3 which extend vertically from the ground so that the feet of the posts mark the corners of an approximately like-sided triangle. In the embodiment shown in the figures the play and training equipment also includes four parts which, in this case best, are described as ladders or bridges, two of which extend between one post and the ground, the other two of which extend between two of the posts.

Figure 9:
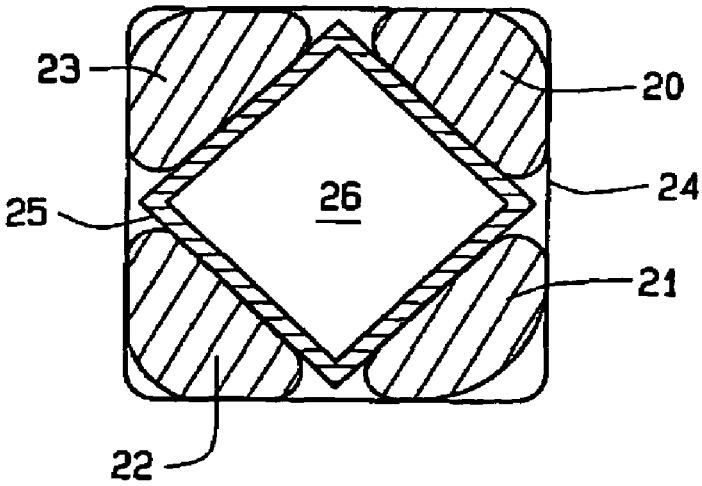
FIG. 9 is a cross section of a mounting bushing for use with the equipment.

Each unit such as a bridge, a ladder or the like is mounted in such a way that it can move with a limited and dampened swinging movement around an imaginary axis between the mounting shaft ends at each end of the unit. This is achieved by use of mounting bushings as shown in FIG. 9. This mounting means provides a rocking motion to the connected unit which is progressively dampened and limited preferably to 15-30 degrees angle at each side from the starting position not allowing all around rotation.

The mounting device or bushing comprises an outer shell 24 which is fixedly mounted to the post, either on its outside or inside the post which then includes some kind of access opening. The outer shell has a square cross section and at each corner of the outer shell, inside the shell there is a rubber bushing 20-23. The rubber bushings are pressed against the outer shell by an inner tube 25 of square cross section, the side surfaces of which are positioned at a 45 degree angle to the side surfaces of the outer shell 24. When the device is mounted, a shaft end 26 of a unit is inserted into the inner tube 25. In other embodiments of the invention the inner tube 25 may be omitted and the shaft end inserted in direct contact with the rubber bushing. This way of mounting the units gives the suppressed, dampened and limited to and fro rocking motion that is desired. Hence, the rubber bushing is a means for enabling the unit to move with a limited and dampened swinging movement about an imaginary axis between the opposite ends of the unit.

Figure 5:
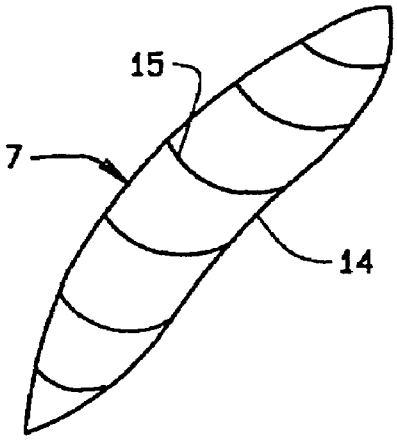
Figure 6:
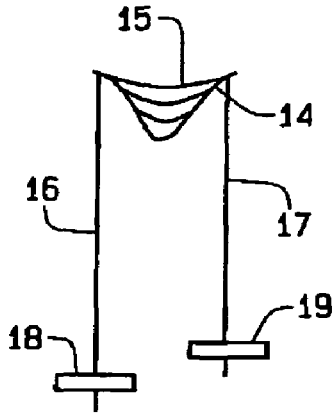
Figure 7:
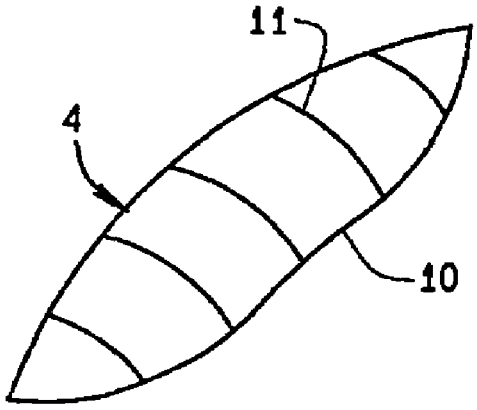
Figure 8:
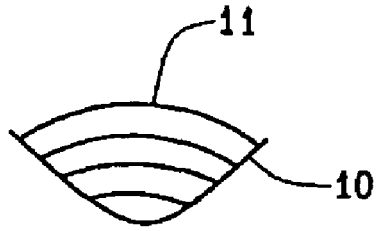

The units, being used as bridges, ladders or otherwise, in their simplest form each comprises a frame forming a closed loop and a number of members inside the frame. The frame preferably has an elliptic shape and the members are parallel to the short axis of the ellipse. In more advanced designs the outer frame also forms a bow while the inside members are straight. In other designs the inside members are bow-shaped either to the convex or the concave side of the frame. Several of these embodiments are shown in the drawings where the frames 10, 12, 14 of the units 4, 6 and 7, respectively, all are bow shaped. In the unit 6, the members 13 within the frame 12 of the unit are straight, while in the units 4 and 7, the members 11, 15 are bowed. The members 11 and 15 may be curved either towards the concave side of the frame as shown in FIGS. 5 and 6 at the unit 7 between the first post 1 and the second post 2, or towards the convex side of the frame as shown in FIGS. 7 and 8 at the unit 4.

It appears from the Figures that the units may be mounted in different ways. The units 4 and 5 are mounted between one post and the ground. They still have the same possibilities of moving as described above and may be used for climbing or other exercises. The two bridging units 6 and 7 are mounted between a pair of posts, 1 and 3 and 1 and 2 respectively. The mounting points or bushings are at the same height at both ends of one unit but the two units are mounted at different heights. The height over the ground is selected to be proper for the intended use of the equipment and for example the unit which is highest may be at such a height that it can barely be touched by a person standing on the ground and reaching up as far as possible.

Figure 2:
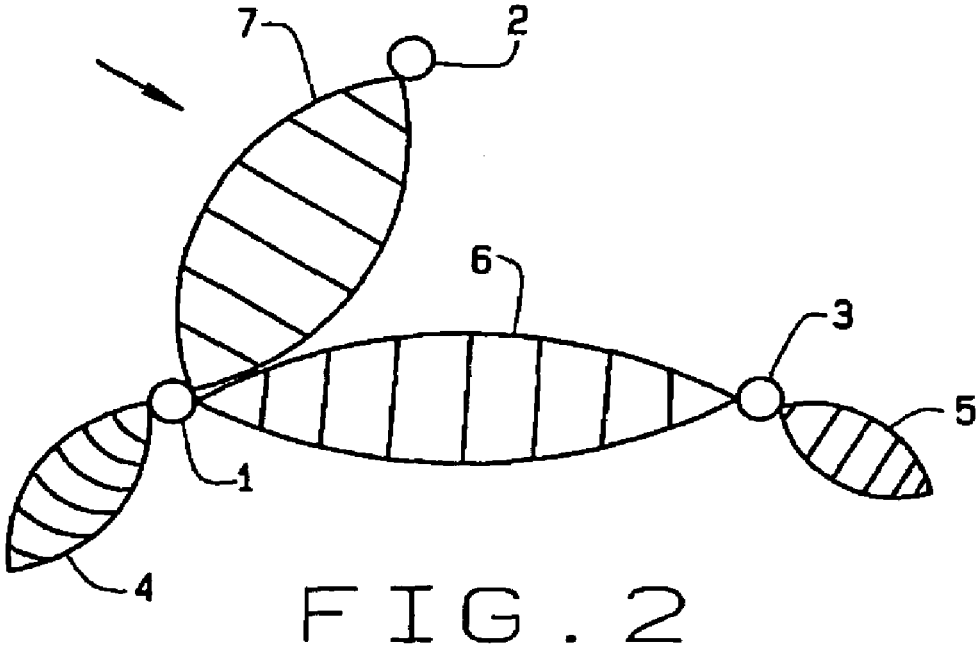
FIG. 2 is a top plan view of the equipment of FIG. 1.
Figure 3:
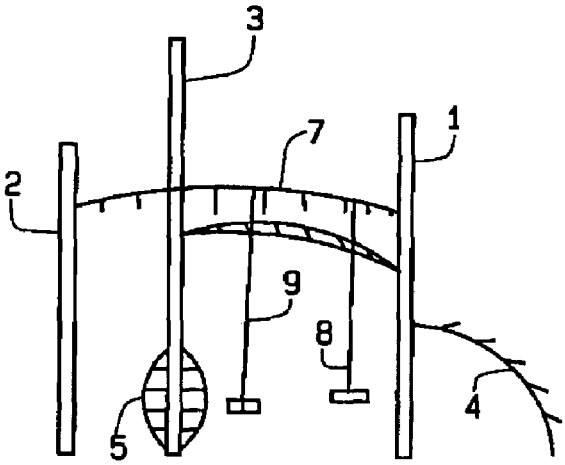
FIG. 3 is side elevational view of the equipment of FIG. 1 in the direction of the arrow in FIG. 2.
Figure 4:
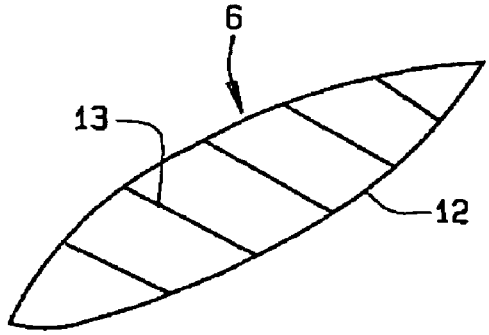
FIGS. 4-8 show various parts of the equipment of FIG. 1.

Other kinds of play and training means may be added to the equipment with new effects. One example is shown in FIGS. 1-3 where a rope 8 with standing or sitting plate has been attached to the bridge 7.

In all of the embodiments described above the mounting of the ladders and bridges is the same at both ends, whether mounted to a post, the ground or any other kind of supporting base. It is, however, possible to have the dampening, resilient connecting means only at one end of a bridge or ladder while the other end may be of a different design, e. g. simply a hole or tube and a shaft end which fits into the hole or tube, all having a circular cross section. The units, whether positioned between two posts or one post and any other support, may be horizontal or inclined, i e the bushings at the two ends of a unit may be mounted at the same or different heights.

Within the scope of the inventive idea there are also many other possibilities to combine the elements of the equipment in various ways. For example a unit may be mounted in a vertical position between a horizontal bar and a ground mounting point. The dampened, rocking movements of the unit will enable this application to be like a moving climbing wall, especially if two or more units are positioned adjacent one another. The dampening and other characteristics of the movements may also be changed and adapted to the intended use of the actual equipment. Furthermore the cross members of the units may be replaced by boards having suitable openings to allow the user to grip around the frame. There may also be grip openings in the board and the openings may be lined with any suitable material in which case a flexible, resilient lining is preferred. The frames have above been described as bowed and elliptic but other shapes are also possible. Examples are rectangular and diamond shapes, flat shapes and combinations of these shapes to form various symmetrical or asymmetrical shapes.

In addition to the units described above also other kind of exercise units may be mounted to the construction for use in connection therewith with new effects. One example is shown in FIGS. 1-3 where a rope 8 with a standing or sitting plate has been attached to the bridge 7. Another example is a kind of chute or gliding path which lends itself well to combination with the above described units as the chute requires or trains similar skills. The chute has the same cross section all along its length and is slightly curved. Its upper surface is shaped like a saddle and so wide that the user cannot form a closed circle with his or her legs under the saddle, thus avoiding a possible risk for damages. The user then must keep the balance without holding on to any kind of support.

The invention claimed is:

1. Play/exercise equipment for use on a playground or in an exercise facility; the equipment comprising:

at least one play unit adapted to be climbed upon; the play unit comprising a bridge; the play unit comprising a pair of opposed side members, a plurality of cross-members extending between the side members, a first end, a second end opposite the first end, and a mounting shaft extending from at least one end of the play unit;

at least one ground engaging post to which the at least one play unit is mounted such that the play unit extends generally outwardly from the at least one ground engaging post to which it is mounted; said play unit first end being adjacent the at least one ground engaging post and the play unit second end being remote from the ground engaging post the post to which said first end is adjacent; and a connector for mounting the at least one play unit to the post; the connector comprising means for enabling the play unit to move with a limited and dampened swinging movement about an imaginary axis between said first and second ends of said play unit; said means comprising a rubber bushing which surrounds the play unit mounting shaft.

2. The playground assembly according to claim 1 wherein the connector includes an outer shell; said bushing being contained within the shell.

3. The playground assembly according to claim 2 wherein the connector includes an inner tube; the inner tube being received within the bushing; the inner tube receiving the mounting shaft of the play unit.

4. The playground assembly according to claim 3 wherein the bushing comprises a plurality of discrete bushing elements spaced about said inner tube.

5. The playground assembly of claim 2 wherein the connector is mounted within the post.

6. The playground assembly of claim 2 wherein the connector is mounted to an outer surface of the post.

7. Play/exercise equipment for use on a playground or in an exercise facility; the equipment comprising:

at least one play unit adapted to be climbed upon; the play unit comprising a ladder; the play unit comprising a pair of opposed side members, a plurality of cross-members extending between the side members, a first end, a second end opposite the first end, and a mounting shaft extending from at least one end of the play unit;

at least one ground engaging post to which the at least one play unit is mounted such that the play unit extends generally outwardly from the at least one ground engaging post to which it is mounted; said play unit first end being adjacent the at least one ground engaging post and the play unit second end being remote from the ground engaging post the post to which said first end is adjacent; and a connector for mounting the at least one play unit to the post; the connector comprising means for enabling the play unit to move with a limited and dampened swinging movement about an imaginary axis between said first and second ends of said play unit; said means comprising a rubber bushing which surrounds the play unit mounting shaft.

8. The playground assembly according to claim 7 wherein the play unit comprises a frame having an elliptic shape and members in the frame which extend parallel to the short axis of the ellipse.

9. The playground assembly according to claim 8 wherein the frame forms a bow.

10. The playground assembly according to claim 8 wherein the members are bowed or curved towards either side of the frame.

11. Play/exercise equipment for use on a playground or in an exercise facility; the equipment comprising:

at least one play unit adapted to be climbed upon; the play unit comprising a pair of opposed side members, a plurality of cross-members extending between the side members, a first end, a second end opposite the first end, and a mounting shaft extending from at least one end of the play unit; the cross-members of the play unit being curved in a plane offset from a plane of the side members of the play unit;

at least one ground engaging post to which the at least one play unit is mounted such that the play unit extends generally outwardly from the at least one ground engaging post to which it is mounted; said play unit first end being adjacent the at least one ground engaging post and the play unit second end being remote from the ground engaging post the post to which said first end is adjacent; and a connector for mounting the at least one play unit to the post; the connector comprising means for enabling the play unit to move with a limited and dampened swinging movement about an imaginary axis between said first and second ends of said play unit; said means comprising a rubber bushing which surrounds the play unit mounting shaft.

12. The equipment of claim 11 wherein the side members of the play unit are curved.

13. The equipment of claim 11 wherein the connector includes an outer shell; said bushing being contained within the shell.

14. The equipment of claim 13 wherein the connector includes an inner tube; the inner tube being received within the bushing; the inner tube receiving the mounting shaft of the play unit.

15. The equipment of claim 14 wherein the bushing comprises a plurality of discrete bushing elements spaced about said inner tube.

* * * * *